US011717729B2

(12) United States Patent
Oh

(10) Patent No.: US 11,717,729 B2
(45) Date of Patent: Aug. 8, 2023

(54) GOLF BALL STAMP

(71) Applicant: Min Gyu Oh, Daegu (KR)

(72) Inventor: Min Gyu Oh, Daegu (KR)

( * ) Notice: Subject to any disclaimer, the term of this patent is extended or adjusted under 35 U.S.C. 154(b) by 0 days.

(21) Appl. No.: 17/688,932

(22) Filed: Mar. 8, 2022

(65) Prior Publication Data

US 2023/0173347 A1 Jun. 8, 2023

(51) Int. Cl.

| | |
|---|---|
| ***A63B 45/02*** | (2006.01) |
| ***B41K 3/02*** | (2006.01) |
| *A63B 37/00* | (2006.01) |

(52) U.S. Cl.

CPC ..... *A63B 45/02* (2013.01); *B41K 3/02* (2013.01); *A63B 37/0022* (2013.01)

(58) Field of Classification Search

CPC ..... A63B 45/02; A63B 37/0022; B41K 3/02
See application file for complete search history.

(56) References Cited

U.S. PATENT DOCUMENTS

| | | | | |
|---|---|---|---|---|
| 8,844,440 | B1 * | 9/2014 | Barr | B41K 1/28 33/528 |
| 2003/0072599 | A1 * | 4/2003 | Ewart | B41K 1/02 401/23 |

FOREIGN PATENT DOCUMENTS

| | | | | |
|---|---|---|---|---|
| CA | 2369385 | A1 * | 7/2003 | A63B 45/02 |
| JP | 2008038550 | A * | 2/2008 | |
| KR | 20-0398308 | Y1 | 10/2005 | |
| KR | 100654621 | B1 * | 12/2006 | |
| KR | 10-1538160 | B1 | 7/2015 | |
| KR | 10-1665981 | B1 | 10/2016 | |
| KR | 20170000789 | * | 3/2017 | |

* cited by examiner

*Primary Examiner* — Christopher E Mahoney
*Assistant Examiner* — Marissa Ferguson-Samreth

(57) ABSTRACT

The present invention relates to a golf ball stamp, and more particularly to, a stamp, which can reduce manufacturing costs due to its simple structure and store ink inside, is easy and convenient to replace the rubber plate that prints a mark on a golf ball, and can print a mark clearly on the rough golf ball surface.

9 Claims, 9 Drawing Sheets

GOLF BALL STAMP

BACKGROUND OF THE INVENTION

Technical Field

The present invention relates to a golf ball stamp, and more particularly to, a stamp, which can reduce manufacturing costs owing to its simple structure and store ink inside, is easy and convenient to replace a rubber plate that prints a mark on a golf ball, and can print a mark clearly on the rough golf ball surface.

Background Art

The number of people visiting golf courses is increasing day by day due to the popularization of golf and the increase of golf-related programs aired in various media.

Recently, rounds are being held on a very tight schedule at almost all golf courses, and there are even golf courses that restrict rounds of less than 4 people.

Therefore, there is no choice but to play with the maximum number of people at all times.

When a large number of people play a round together, it is often impossible to determine whose golf ball is nearby. In particular, this occurs more frequently after on-green, resulting in large and small disputes.

Therefore, in order to prevent this, each individual uses a marker pen to mark his or her golf ball or mark his or her name, initials, or the like.

However, it is not an easy task to accurately mark a small golf ball with a curved and uneven surface by hand.

In order to solve the above problems, a golf ball liner has been suggested in patent registration no. 10-1665981 (hereinafter, referred to as "prior art").

The prior art includes a housing, a stamp, a support part and a moving part, wherein the shape of each part is very complicated, so the mold cost is high. In particular, since the part of the stamp for carrying out printing while coming into contact with a golf ball is molded into a curved surface form, there is a problem in that the manufacturing cost is high to provide various types of stamps.

In addition, the prior art has further problems in that since the support part includes a spring provided therein in order to elastically support the stamp that is lifted or lowered inside, ink must be carried separately and is often lost in the process of carrying it.

SUMMARY

Technical Problems

The present invention has been derived to solve the above problems and it is an object of the present invention to provide a stamp, which has a simple structure, can be carried while storing ink inside, and has a rubber plate for coming into contact with a golf ball so as to print a mark on the golf ball, wherein the rubber plate is formed in a flat shape so as to be supplied inexpensively to consumers and print a mark clearly on the uneven surface of the golf ball.

Technical Solutions

In order to achieve the objectives described above, according to the present invention, there is provided a golf ball stamp, comprising: an outer case in the form of a pipe with open top and bottom portions; a support member inserted into the outer case and having a depression part that is a spherical surface of a predetermined curvature on an upper surface thereof; and a rubber plate, which is formed in the form of a plate with an elastic material, is fastened to the upper portion of the support member, and has print protrusion parts of a predetermined shape protruding from the upper surface thereof so as to be exposed through the insertion hole of the outer case, wherein while being supported by the depression part of the support member, the rubber plate is elastically deformed and pressed against the golf ball so that ink is transferred from the print protrusion parts to the golf ball surface.

Herein, it is preferable that a flange is further provided by bending and extending the upper end of the body of the outer case inward so as to fix the rubber plate.

In addition, it is preferable to further provide an inner case, which has an accommodation part in the form of a space for accommodating the ink therein, and is inserted into the outer case and screw-coupled to the outer case so as to support the support member.

Herein, it is preferable to further form a rectangular groove on the lower surface of the inner case so as to insert a tool or a coin so that the inner case can be easily separated from the outer case.

At this time, it is preferable that the depression part of the support member is formed to have the same curvature as the spherical surface of the golf ball, so that the ink is transferred while the rubber plate is precisely in close contact with the outer surface of the golf ball.

Herein, it is preferable to further provide a cap fastened to the upper portion of the outer case so as to seal the exposed rubber plate.

Advantageous Effects

According to the present invention, the stamp configured as described above has a simple structure and can carry the ink with the stamp by accommodating the ink therein.

In addition, in order to print various letters or patterns, various types of rubber plates must be produced. According to the present invention, the rubber plate is formed in a flat shape and thus it is possible to significantly reduce the manufacturing costs.

DETAILED DESCRIPTION

Figure 1:
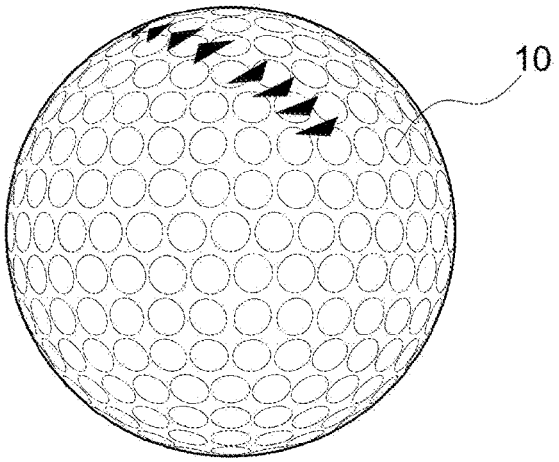
FIG. 1 is a view showing a state in which printing is made on the surface of a golf ball by using a stamp according to the present invention.

Hereinafter, preferred embodiments of the present invention will be described in detail with reference to the accompanying drawings, wherein the present invention will be described on the premise that like reference numerals in the drawings refer to like components.

In the detailed description or claims of the invention, when it is said that any one component "includes" another component, this should not be construed as being limited to being made up of only the component, unless otherwise stated, and it should be understood that other components may be further included.

As used herein, terms such as "upper", "lower", "bottom", "front", "rear", "below", etc. are merely for facilitating description and refer to the orientation of the components as shown in the drawings.

Figure 2:
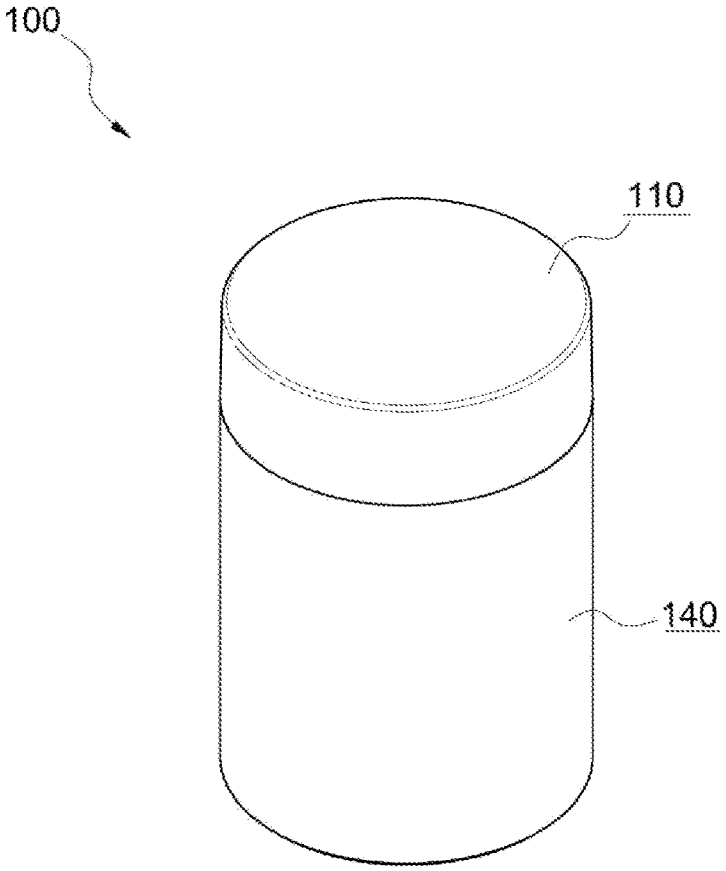
FIG. 2 is a perspective view showing the stamp according to the present invention.
Figure 3:
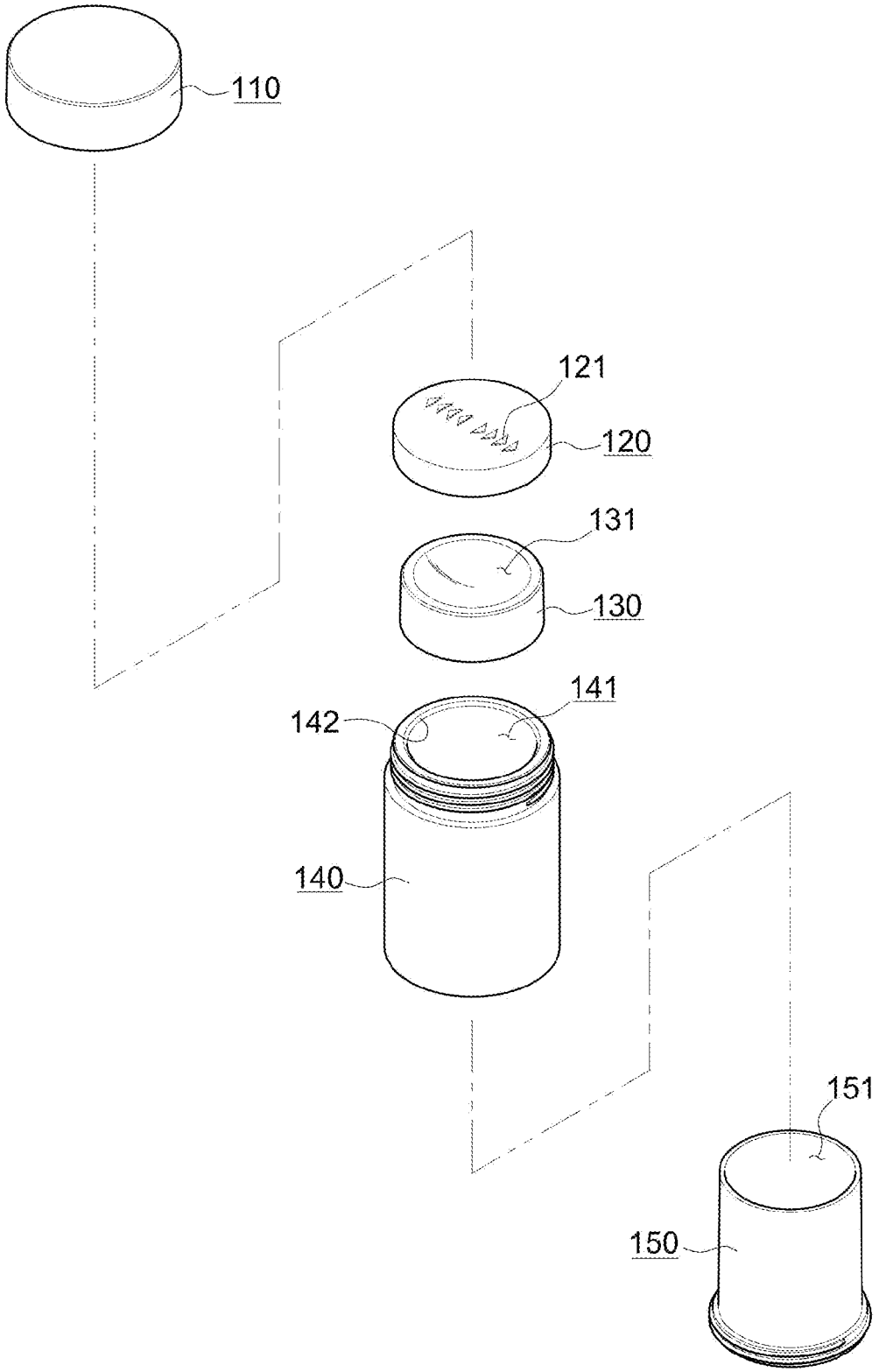
FIG. 3 is an exploded perspective view showing the stamp according to the present invention.

FIG. 1 is a view showing a state in which printing is made on the surface of a golf ball 10 by using a stamp 100 according to the present invention, FIG. 2 is a perspective view showing the stamp 100 according to the present invention, and FIG. 3 is an exploded perspective view showing the stamp according to the present invention.

The stamp 100 according to the present invention includes an outer case 140, a support member 130 and a rubber plate 120 inserted into the upper inner portion of the outer case 140, a cap 110 that is fastened to the upper portion of the outer case 140 so as to cover and seal the rubber plate 120, and an inner case 150 that is inserted and fastened to the lower portion of the outer case 140, as shown in FIG. 2 and FIG. 3.

The outer case 140 has a body formed in the form of a pipe, in which upper and lower portions are open, and a thread formed on the upper outer surface of the body, and is screw-coupled and fastened to the cap 110.

Figure 4:
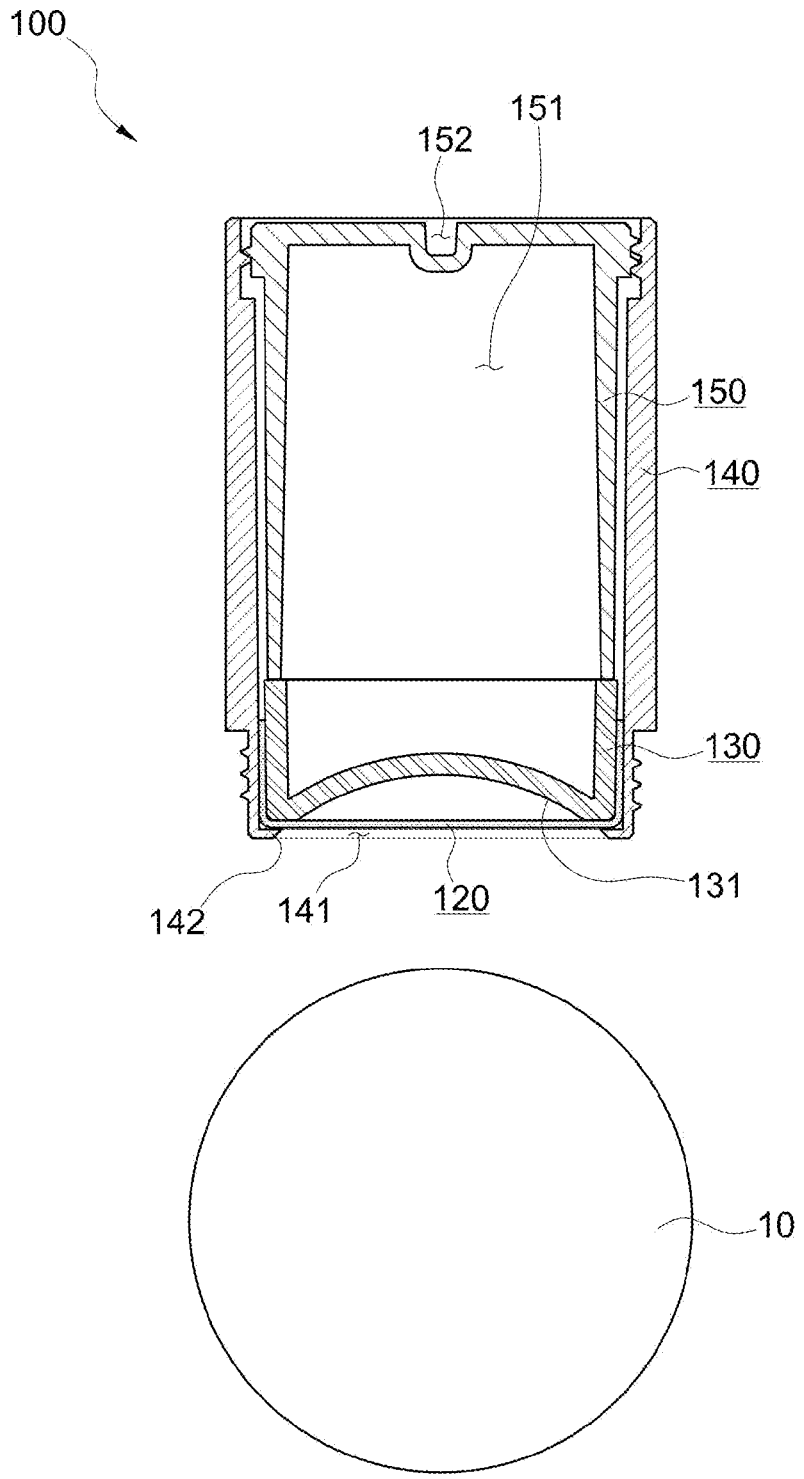
FIG. 4 and FIG. 5 are cross-sectional views showing a printing process of a golf ball using the stamp according to the present invention, respectively.

In addition, as shown in FIG. 4, the upper end of the outer case 140 is bent inward and extended so that a flange 142 is protruded.

The support member 130 and the rubber plate 120 are inserted into the outer case 140.

The upper surface of the body of the support member 130 is formed with a depression part 131 in the form of a spherical surface having a predetermined curvature. The depression part 131 is preferably formed to have a curvature corresponding to that of the outer surface of the golf ball 10.

In addition, the rubber plate 120 is coupled to the upper portion of the support member 130.

The rubber plate 120 includes the body, which is made of a rubber or synthetic rubber material with excellent elasticity and is formed in a cylindrical shape with an open lower portion, wherein a print protrusion part 121 is formed in an embossed shape on the flat upper surface of the body.

The support member 130 is inserted and coupled to the open lower portion of the rubber plate 120, and the combined rubber plate 120 and the support member 130 are inserted into the open lower portion of the outer case 140.

The rubber plate 120 and the support member 130 coupled to the outer case 140 are inserted, and the inner case 150 is inserted and fastened to the lower portion of the outer case 140.

The inner case 150 has a body formed in a cylindrical shape with an open upper portion, an accommodation part 151 formed inside the body, and a thread formed on the lower outer surface so as to be screw-coupled to the outer case 140.

When the rubber plate 120 and the support member 130 are inserted inside the outer case 140 and the inner case 150 is fastened to the outer case 140, as shown in FIG. 3, the support member 130 is supported by the inner case 150 and comes in close contact with the flange 142 of the outer case 140, so that the support member 130 and the rubber plate 120 are fixed to the outer case 140 inside the outer case 140, as shown in FIG. 4.

As shown in FIG. 4, since the rubber plate 120 is flat while the rubber plate 120 and the support member 130 are fixed inside the outer case 140, the rubber plate 120 is spaced apart from the center of the depression part 131 of the support member 130 at a predetermined distance.

Although not shown in the drawings, ink can be stored in the inner accommodation part 151 of the inner case 150 and carried along with the stamp 100.

In addition, as shown in FIG. 3, by fastening the cap 110 to the outer case 140, the exposed rubber plate 120 can be sealed so as to be carried.

Figure 5:
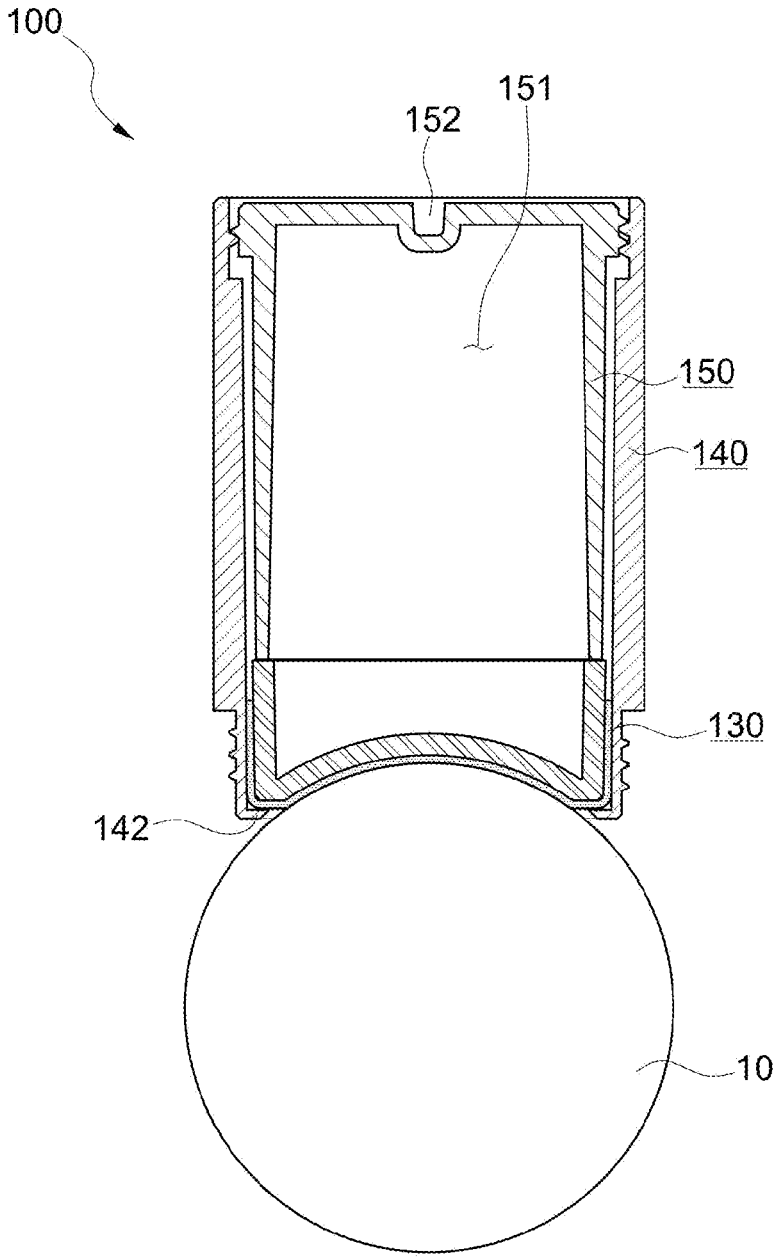

When using the stamp 100 of the present invention configured as described above, the cap 110 is opened, the stamp 100 is placed on the golf ball 10 to be printed as shown in FIG. 4, and then the stamp 100 is lowered as shown in FIG. 5 so that the rubber plate 120 comes into close contact with the golf ball 10.

As the stamp 100 descends, the top of the golf ball 10 comes into contact with the exposed rubber plate 120. As the stamp 100 continues to descend, the flat rubber plate 120 elastically deforms in the direction of the support member 130.

As the rubber plate 120 is elastically deformed and the rubber plate 120 comes into contact with the depression part 131 of the support member 130, a mark is printed on the golf ball 10 according to the shape of the print protrusion part 121 formed on the rubber plate 120.

In other words, at the moment when the rubber plate 120 comes into contact with the upper center of the golf ball 10 while the stamp 100 descends, the golf ball 10 is initially fixed by the rubber plate 120 with high surface friction so that the golf ball does not move. As the stamp 100 gradually descends, the contact area between the rubber plate 120 and the golf ball becomes increased and the golf ball 10 is fixed more firmly.

After the print position of the golf ball 10 is accurately set while the rubber plate 120 comes in contact with the support member 130, the rubber plate 120 is pressed against the golf ball 10 by the force of a user pressing the stamp 100 so that printing a mark on the golf ball 10 is completed.

As described above, since the rubber plate 120 is made of a rubber or synthetic rubber material with high surface friction, the golf ball 10 is fixed so as not to move by the rubber plate 120 with a high coefficient of friction at the moment when the rubber plate 120 comes into contact with the golf ball 10. Furthermore, as the stamp 100 continues to descend, the rubber plate 120 is elastically deformed according to the shape of the outer surface of the golf ball 10 and printing is carried out on the surface of the golf ball 10.

At this time, as shown in FIG. 5, the depression part 131 of the support member 130 which is formed in the shape of the outer surface of the golf ball 10 supports presses the rubber plate 120, so that the shape of the print protrusion part 121 of the rubber plate 120 is clearly printed on the outer surface of the golf ball 10 that is uneven.

When the stamp 100 is lifted after printing is finished, the rubber plate 120 is elastically restored to the flat state, as shown in FIG. 4.

Figure 9:
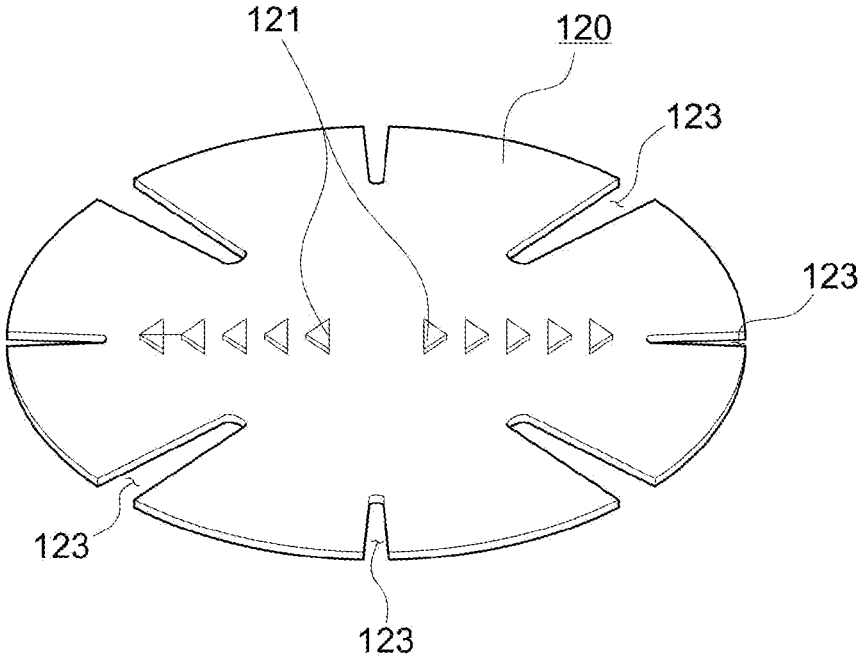
FIG. 9 is a perspective view showing a rubber plate according to another embodiment.

FIG. 9 is a perspective view showing a rubber plate according to another embodiment of the present invention.

Referring to FIG. 9, a rubber plate 120 according to another embodiment is radially formed with slits 123 cut to the edge thereof from the positions, which are spaced a certain distance from the center of the circular body thereof.

At this time, it is preferable that the slits 123 are configured such that each one pair of the slits 123 is symmetrical on the basis of the center of the rubber plate 120.

Figure 10:
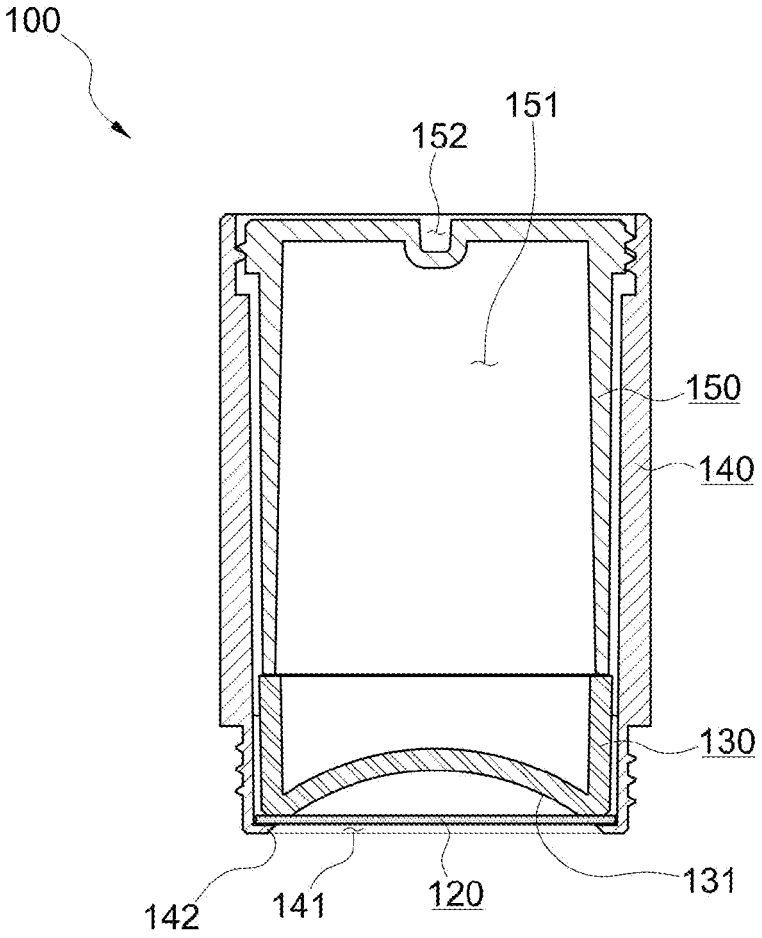
FIG. 10 is a cross-sectional view showing a stamp in which a rubber plate is fastened according to another embodiment.

The rubber plate 120 configured as above elastically deforms and enables printing on the surface of the spherical golf ball while being pressed and fixed by the flange 142 of the outer case 140 and the support member 130, as shown in FIG. 10. In this process, as the width of the slits 123 of the rubber plate 120 is narrowed, the rubber plate 120 is completely in close contact with the surface of the spherical golf ball without any lifting parts, so that printing is performed accurately.

In order to allow the rubber plate 120 to more completely adhere to the golf ball surface, it is preferable that each of the slits 123 is formed to gradually widen toward the edge of the rubber plate 120, as shown in FIG. 9.

In addition, when forming long slits 123 and short slits 123, it is preferable that the long slits 123 and the short slits 123 are sequentially and alternately formed, as shown in FIG. 9.

By alternately providing the slits 123 of different lengths rather than providing the slits 123 of the same length, printing is performed in a state in which the rubber plate 120 is more three-dimensionally adhered to the surface of the golf ball.

Ink on the print protrusion part 121 of the rubber plate 120 is transferred to the golf ball 10 through the above process, wherein a sufficient amount of ink must be applied to the print protrusion part 121 of the rubber plate 120 for clean printing.

To this end, an ink container is stored inside the stamp 100 of the present invention, wherein in order to take out the ink container, the inner case 150 must be separated from the outer case 140.

Figure 6:
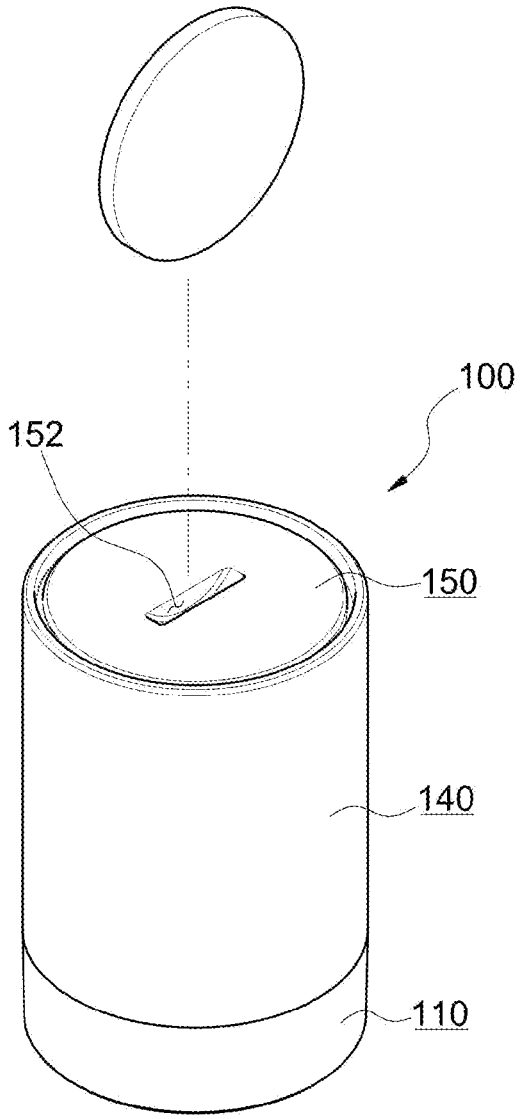
FIG. 6 is a perspective view showing a state in which the inner case of the stamp is opened using a coin.
Figure 7:
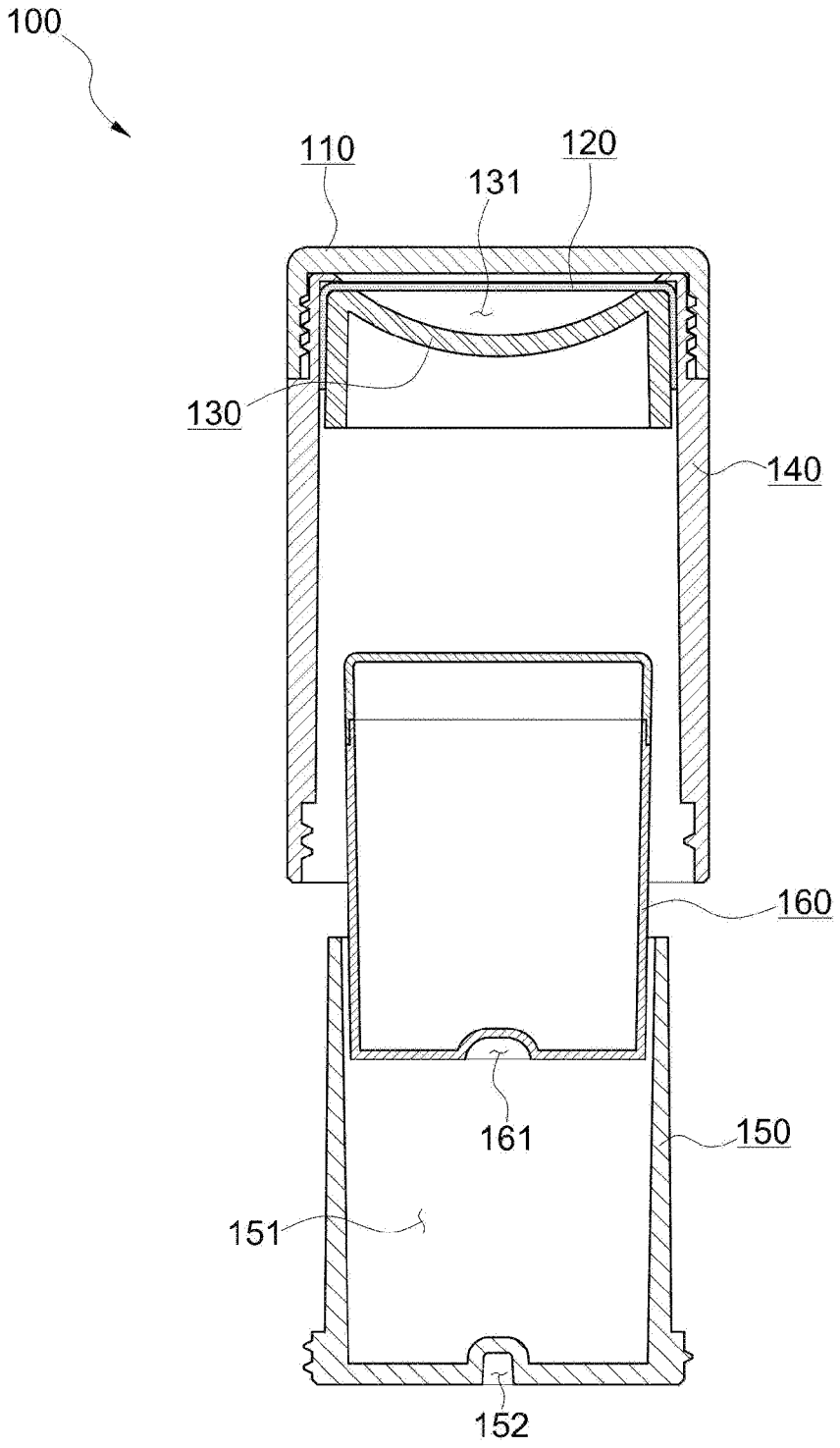
FIG. 7 is a cross-sectional view showing a state in which the ink container is accommodated inside the stamp of the present invention.

According to the present invention, for easy separation of the inner case 150, a rectangular groove 152 is formed on the bottom surface of the inner case 150 as shown in FIG. 6 and FIG. 7 and the groove 152 is formed on the bottom surface of the inner case 150 as shown in FIG. 7, so that a protrusion part is formed on the inner surface of the inner case 150.

If a tool such as a screwdriver or a coin is inserted and rotated in the groove 152 formed on the bottom surface of the inner case 150 as shown in FIG. 6, the inner case 150 is easily separated so that the ink container stored in the inner accommodation part 151 of the inner case 150 can be withdrawn from the inner accommodation part 151 of the inner case 150 so as to be used.

As described above, the ink container 160 is accommodated inside the inner case 150, wherein a groove 161 is formed on the bottom surface of the ink container 160 as shown in FIG. 7. Therefore, when the ink container 160 is accommodated in the inner case 150, the protrusion part of the inner case 150 is inserted into the groove 161 on the bottom surface of the ink container 160. Therefore, when carrying the stamp 100 of the present invention or using the present invention so as to print a mark on a golf ball, the ink container 160 is firmly fixed in the inner case 150 without rattling.

As described above, the stamp 100 of the present invention prints a mark on the outer surface of the golf ball 10 while the flat rubber plate 120 is elastically deformed. Then the flat rubber plate 120 is elastically restored to the flat state again after printing is completed. In the process of repeating the elastic deformation and restoration, the rubber plate 120 may be separated from the support member 130.

Figure 8:
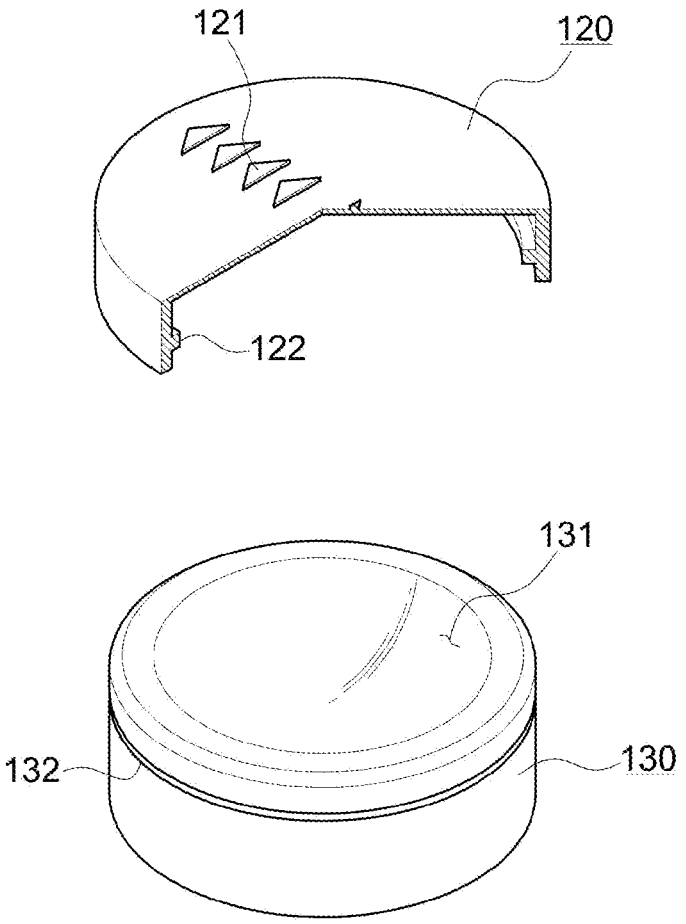
FIG. 8 is a perspective view showing a fastening structure of a support member and a rubber plate constituting the present invention.

In order to prevent this, as shown in FIG. 8, a fastening groove part 132 is formed in the form of a groove on the side surface of the support member 130 and a fastening protrusion part 122 is protrudingly formed on the inner surface of the body of the rubber plate 120.

When the rubber plate 120 is fastened to the support member 130, the fastening protrusion part 122 of the rubber plate 120 is inserted into the fastening groove part 132 of the support member 130 so that the rubber plate 120 is not easily separated from the support member 130 even if the stamp 100 is repeatedly used.

In order to print different letters or patterns on the golf ball 10, the rubber plate 120 must be replaced. Herein, the inner case 150 is separated and the support member 130 and rubber plate 120 are taken out from the outer case 140. Then, after the rubber plate 120 is replaced with a new rubber plate 120 and the new rubber plate 120 is coupled to the support member 130, the support member 130 is inserted into the outer case 140 and the inner case 150 is coupled to the outer case 140.

As described above, according to the present invention, the stamp has a simple structure and can carry the ink with the stamp while accommodating the ink therein.

In addition, in order to print various letters or patterns, it is necessary to produce various types of rubber plate 120. According to the present invention, since the rubber plate 120 is formed in a flat shape, it is possible to significantly reduce the manufacturing costs.

The technical idea of the present invention has been reviewed through the above-described embodiments.

It is apparent that those of ordinary skill in the art to which the present invention pertains can variously modify or change the above-described embodiments from the description of the present invention.

In addition, even if it is not explicitly shown or described, it is obvious that those of ordinary skill in the art to which the present invention belongs can make various types of modifications including the technical idea according to the present invention from the description of the present invention, and these still fall within the scope of the present invention.

The above embodiments described with reference to the accompanying drawings have been described for the purpose of explaining the present invention, and the scope of the present invention is not limited to these embodiments.

What is claimed is:

1. A golf ball stamp, comprising:

an outer case in the form of a pipe with open top and bottom portions;

a support member inserted into the outer case and having a depression part that is a spherical surface of a predetermined curvature on an upper surface thereof;

an inner case configured to be received within the outer case and screw coupled to the outer case, wherein at least a portion of the inner case towards an open upper portion of the inner case interfaces with the support member when screw coupled thereby supporting the support member; and a rubber plate, which is formed in the form of a flat plate with an elastic material configured to be deformed with an external force, is coupled to an upper portion of the support member wherein the rubber plate is spaced apart from at least a center of the depression of the support member, and has print protrusion parts of a predetermined shape protruding from the upper surface thereof so as to be exposed through an insertion hole of the outer case, wherein while being supported by the depression part of the support member, the rubber plate, when pressed against a golf ball, is elastically deformed towards the depression part to come in contact with the support member and ink is transferred from the print protrusion parts to a surface of the golf ball, and the rubber plate upon removal of the external force, moves away from the depression part to recover to the original flat profile.

2. The golf ball stamp according to claim 1, wherein the outer case further includes a flange formed by bending and extending an upper end of a body of the outer case inward so as to fix the rubber plate.

3. The golf ball stamp according to claim 1, wherein:

the inner case, defines an accommodation part for accommodating an ink container; and the open upper portion of the inner case provides access to the accommodation part.

4. The golf ball stamp according to claim 1, wherein a rectangular groove is formed on a lower surface of the inner case.

5. The golf ball stamp according to claim 4, wherein a groove is defined on a bottom surface of the ink container, wherein the groove is configured to receive at least a portion of the rectangular groove of the inner case when the ink container is accommodated within the inner case.

6. The golf ball stamp according to claim 1, further comprising a cap fastened to an upper portion of the outer case so as to seal the exposed rubber plate.

7. The golf ball stamp according to claim 1, wherein the rubber plate has radially formed incision slits cut from positions spaced apart from a center thereof by a predetermined distance to an edge thereof.

8. The golf ball stamp according to claim 1, wherein the support member defines a space for accommodating at least a portion of an ink container, when the ink container is accommodated within the inner case and the inner case is screw coupled to the outer case.

9. The golf ball stamp according to claim 1, wherein the slits comprises of long slits and short slits disposed alternatively, wherein the slits gradually widen towards edge of the rubber plate.

* * * * *